US007300017B1

(12) United States Patent
Sanda

(10) Patent No.: US 7,300,017 B1
(45) Date of Patent: Nov. 27, 2007

(54) REEL FOR METAL LINEAR MATERIAL

(75) Inventor: Kenji Sanda, Ono (JP)

(73) Assignee: Tokusen Kogyo Co., Ltd., Hyogo Pref. (JP)

( * ) Notice: Subject to any disclaimer, the term of this patent is extended or adjusted under 35 U.S.C. 154(b) by 0 days.

(21) Appl. No.: 11/507,441

(22) Filed: Aug. 22, 2006

(51) Int. Cl.
*B65H 75/14* (2006.01)

(52) U.S. Cl. ..... 242/614.1; 242/610.5

(58) Field of Classification Search ..... 242/614, 242/614.1, 608, 608.2, 608.7, 608.8, 610.1, 242/610.3, 610.5, 118.7, 118.8
See application file for complete search history.

(56) References Cited

U.S. PATENT DOCUMENTS

| | | | | |
|---|---|---|---|---|
| 1,675,507 | A * | 7/1928 | Mossberg | 242/614.1 |
| 1,843,235 | A * | 2/1932 | Kjellstrom | 242/614 |
| 1,849,977 | A * | 3/1932 | Decombe | 242/614 |
| 2,159,469 | A * | 5/1939 | Boswin | 242/614.1 |
| 2,284,426 | A * | 5/1942 | Howsam | 242/614.1 |
| 2,321,084 | A * | 6/1943 | Howsam et al. | 242/614.1 |
| 2,494,521 | A * | 1/1950 | Emery et al. | 242/614 |
| 2,494,522 | A * | 1/1950 | Schaefer | 242/614 |
| 2,574,845 | A * | 11/1951 | Schaefer | 242/614.1 |
| 5,106,031 | A * | 4/1992 | Sanda et al. | 242/614.1 |
| 6,305,639 | B1 * | 10/2001 | Bocciola | 242/614.1 |
| 6,959,892 | B2 * | 11/2005 | Sanda | 242/614.1 |

FOREIGN PATENT DOCUMENTS

| | | | |
|---|---|---|---|
| JP | 57-48574 | * | 3/1982 |
| JP | 9-295768 | | 11/1997 |
| JP | 2002-370152 | | 12/2002 |

* cited by examiner

*Primary Examiner*—William A. Rivera
(74) *Attorney, Agent, or Firm*—Browdy and Neimark, PLLC

(57) ABSTRACT

A reel around which a fine metal linear material, such as a filament for a tire cord, a saw wire, or the like, is wound, is formed by fixedly joining flanges (2) made of a steel sheet and having a hollow ring-shaped outer edge reinforcing portion (8) at an outer edge to both ends of a winding drum (1). In the outer edge reinforcing portion (8) of the flange (2), an outer edge portion of the flange (2) is bent back outward in a reel axial direction at a substantially right angle with respect to a substantially flat inner surface thereof and is then curled inward in a radial direction so that the metal linear material can be wound up to the very outer edge of the flange (2).

6 Claims, 2 Drawing Sheets

REEL FOR METAL LINEAR MATERIAL

BACKGROUND OF THE INVENTION

1. Field of the Invention

The present invention relates to a reel for a metal linear material. More particularly, the present invention relates to a reel for a metal linear material suitable as a reel for winding a fine metal linear material, such as a reel for unwinding a filament for a tire cord in a twisting machine for a tire cord, a reel for winding a saw wire in a wire saw, and the like.

2. Description of the Related Art

Metal linear material reels for winding a fine metal linear material, such as a filament for a tire cord, a saw wire, or the like, are typically formed of a thick steel material. The reels are divided, depending on how they are manufactured, into an integrally formed reel (machined reel) obtained by integrally machining a winding drum portion and flange portions from a steel material, a welded reel obtained by separately producing a winding drum portion and flange portions from a steel material and integrating the winding drum portion and the flange portions together by welding, an assembled reel obtained by separately producing a winding drum portion and flange portions from a steel material and joining the winding drum portion and the flange portions together using bolts, and the like (see, for example, JP 2002-370152A). However, when these reels made of a thick steel material are used for fine metal linear materials, it is necessary to further increase the thickness of the winding drum portion and the flange portions so as to secure sufficient strength and rigidity, and in some cases, the joint portions of the winding drum portion and the flange portions need to be reinforced and the winding drum portion itself needs to be reinforced, resulting in a considerable increase in the weight of the reel, leading to a problem with handling, an increase in transportation cost, and also an increase in material cost and machining cost.

Regarding the metal linear material reel, when a fine metal line, for example, a fine metal line having a line diameter of about 0.15 to 0.40 mm which is used as a filament for a steel cord (tire cord) for reinforcement of rubber products, or an ultra-fine metal line (saw wire) for a wire saw having a line diameter of 0.12 to 0.16 mm or less is wound around the reel with a predetermined tension (e.g., 0.4 to 1.5 kg), a large winding pressure (squeezing force) is applied to the winding drum portion due to the winding tension. In addition, when a number of layers of the fine metal line are wrapped around the reel, a lateral pressure (flaring force) is applied to the flange portions. The winding pressure (squeezing force) and the lateral pressure (flaring force) applied to the winding drum portion acceleratedly increase with a decrease in the line diameter of the wound metal linear material, a decrease in the winding pitch, an increase in the winding tension, and an increase in the number of layers of the wound metal linear material.

Therefore, in the reel around which such a fine metal linear material is wound, the winding drum portion needs to have sufficient strength and rigidity against the winding pressure (squeezing force) and expansion caused by the lateral pressure flaring the flanges, and the flange portions needs to have sufficient strength against the lateral pressure and sufficient rigidity against flexure due to the lateral pressure. The flexure of the flange due to the lateral pressure causes deformation (dent) of the winding drum portion, and the deformation of the winding drum portion leads to hunting when the wire is wound, which may cause cutting of the wire.

Particularly, in the case of a "slim type reel" in which the height of the flange portions is larger than the width of the winding drum portion, the winding pressure applied to the winding drum portion is much larger than the pressure (lateral pressure) applied to the flange portions. Therefore, the pressure applied to the flange portions flares both the flange portions, i.e., the flange portions go away from each other at the outer edges. The lateral pressure may reach several tons or several tens of tons when a saw wire is wound around a wire saw reel in an amount corresponding to a weight of 40 to 60 kg or more. In this case, as a result, stress is concentrated to corners which are joint portions between the winding drum portion and the flange portions, likely leading to occurrence of damage in these portions. On the other hand, in the case of a "long drum reel" in which the width of the winding drum portion is larger than the diameter of the flange portions, a pressure caused by the winding tension is concentrated to the winding drum portion, so that the winding pressure (squeezing force) applied to the winding drum portion increases. Due to this large winding pressure (squeezing force), the winding drum portion is deformed such that the diameter of a middle portion of the winding drum portion shrinks. This deformation causes both flange portions to fall inward. In the case of such a reel, damage is likely to occur in the winding drum portion.

Thus, conventional reels made of a thick steel material do not achieve a reduction in weight while securing strength and rigidity sufficient as a reel for a fine metal linear material which is used particularly for a twisting machine for a tire cord, or a wire saw.

Therefore, a metal linear material reel capable of reducing the weight while securing the strength and rigidity, has been developed in which flanges having swelling reinforcing ribs which are formed on an outer surface by presswork of a high-tensile steel sheet, and a hollow ring-shaped outer edge reinforcing portion which is formed by bending back the outer edge, are fixedly joined to both ends of a winding drum by welding (see, for example, JP 9-295768A).

When a light-weight fine metal linear material, such as a filament for a tire cord, a saw wire, or the like, is wound around the above-described reel in which flanges having swelling reinforcing ribs which are formed on an outer surface by presswork of a high-tensile steel sheet, and a hollow ring-shaped outer edge reinforcing portion which is formed by bending back the outer edge, are fixedly joined to both ends of a winding drum by welding, the strength and rigidity are sufficient to withstand the winding weight to some extent. However, the hollow ring-shaped outer edge reinforcing portion provided so as to prevent deformation of the flange outer edge portion due to a shock when, for example, the collars of reels strike each other during transportation has a substantially circular cross-section, so that the flange has a round inner surface at the outer edge, and therefore, a substantially flat portion of the flange is reduced. As a result, the amount of a metal linear material wound around the reel is reduced, though a metal linear material can be wound up to the very outer edge of the flange in machined reels and the like.

SUMMARY OF THE INVENTION

Therefore, an object of the present invention is to provide a reel for a metal linear material which has a flange made of a steel sheet, the flange having a hollow ring-shaped outer edge reinforcing portion, and around which a metal linear material can be wound up to a very outer edge thereof.

To achieve the object, the present invention provides A reel for a metal linear material comprising a winding drum, and flanges made of a steel sheet and fixedly joined at both ends of the winding drum. The flanges each have a hollow ring-shaped flange outer edge reinforcing portion at an outer edge thereof, the hollow ring-shaped flange outer edge reinforcing portion being continuous to a substantially flat inner surface of the flange. The flange outer edge reinforcing portion has a structure which is bent back outward in a reel axial direction at a substantially right angle with respect to the substantially flat inner surface.

In this reel, the flange outer edge reinforcing portion is bent back outward in a reel axial direction at a substantially right angle with respect to the substantially flat inner surface. Therefore, the inner surface of the flange is substantially flat up to the very outer edge, so that a metal linear material can be wound around the winding drum up to the very flange outer edge.

Also in this reel, each flange may comprise a plurality of flange members made of a steel sheet and overlaid together in an axial direction to form a multiplex structure. A first flange member provided at an outer position in the axial direction and a second flange member provided at an inner position in the axial direction may be overlaid together at an outer edge portion, and the overlaid outer edge portion may be bent back throughout a whole circumference to form the flange outer edge reinforcing portion. With this structure, rigidity and strength can be improved due to the flange multiplex structure.

Also, in this case, the reel may further comprise an outer drum provided outside a drum member of the winding drum, and ring-shaped spacers having an L-shaped cross-section provided at both sides in the axial direction of the outer drum, forming a reel surface flush with the outer drum and flange surfaces flush with the second flange members of the flanges. Both ends of the drum member are fixed to the first flange members of the flanges by welding, the spacers are fixed to inner circumferences of the second flange members of the flanges by butt welding, and the outer drum and the spacers at both the ends thereof are fixed to each other by butt welding. Thereby, it is possible to improve the strength of the winding drum against a squeezing force when a metal linear material is wound around the winding drum, and further improve the rigidity and strength of the flange against deformation.

As described above, according to the present invention, in the metal linear material reel having flanges made of a steel sheet provided with a hollow ring-shaped outer edge reinforcing portion, the inner surface of the flange can be substantially flat up to the very outer edge, thereby making it possible to wind a metal linear material up to the very flange outer edge.

The above, and other objects, features and advantages of the present invention will become apparent from the following detailed description which is to be read in conjunction with the accompanying drawings.

DESCRIPTION OF THE PREFERRED EMBODIMENTS

Figure 1:
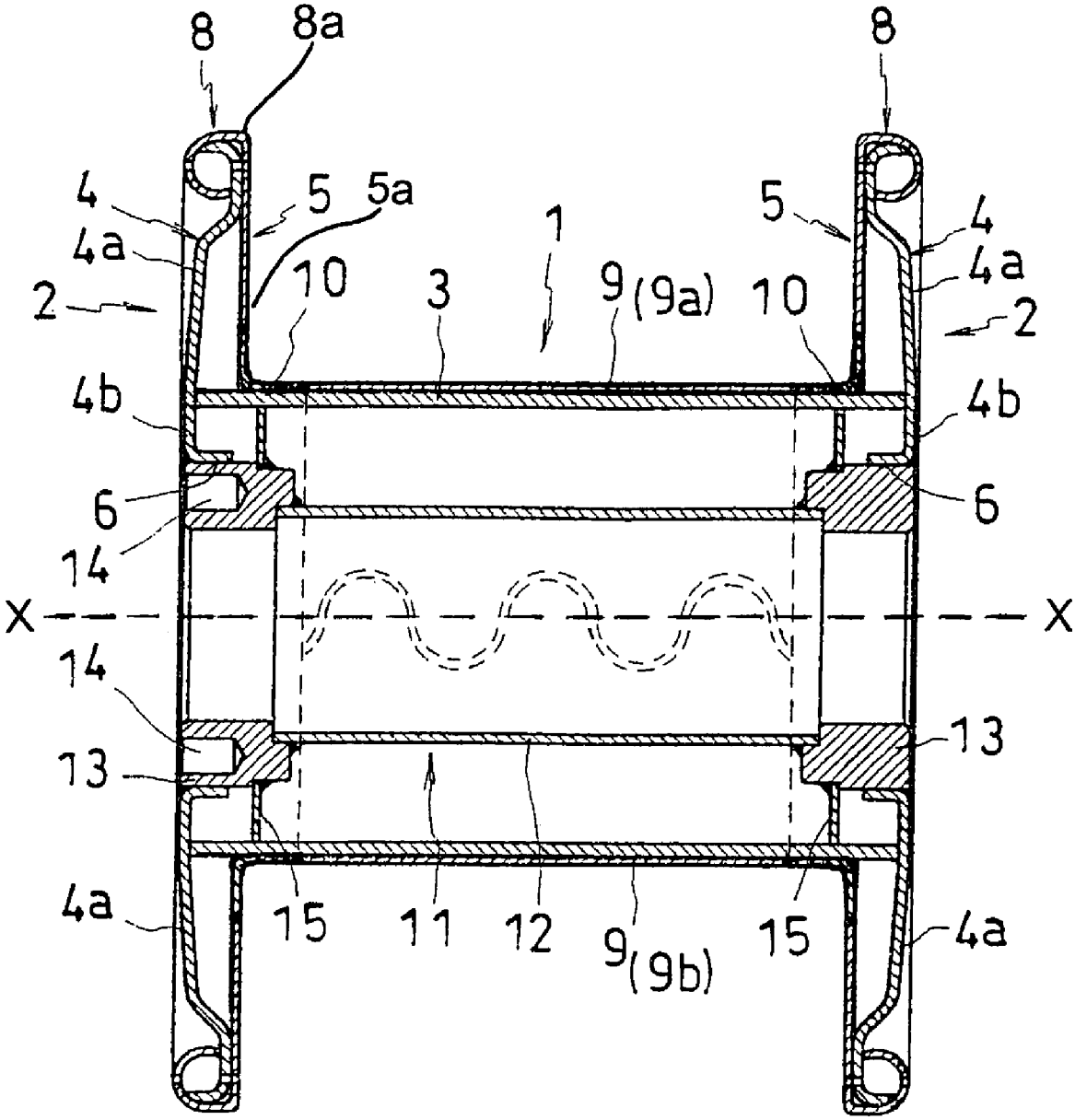
FIG. 1 is a vertical cross-sectional view of a reel according to an embodiment (taken along line A-A in FIG. 2)
Figure 2:
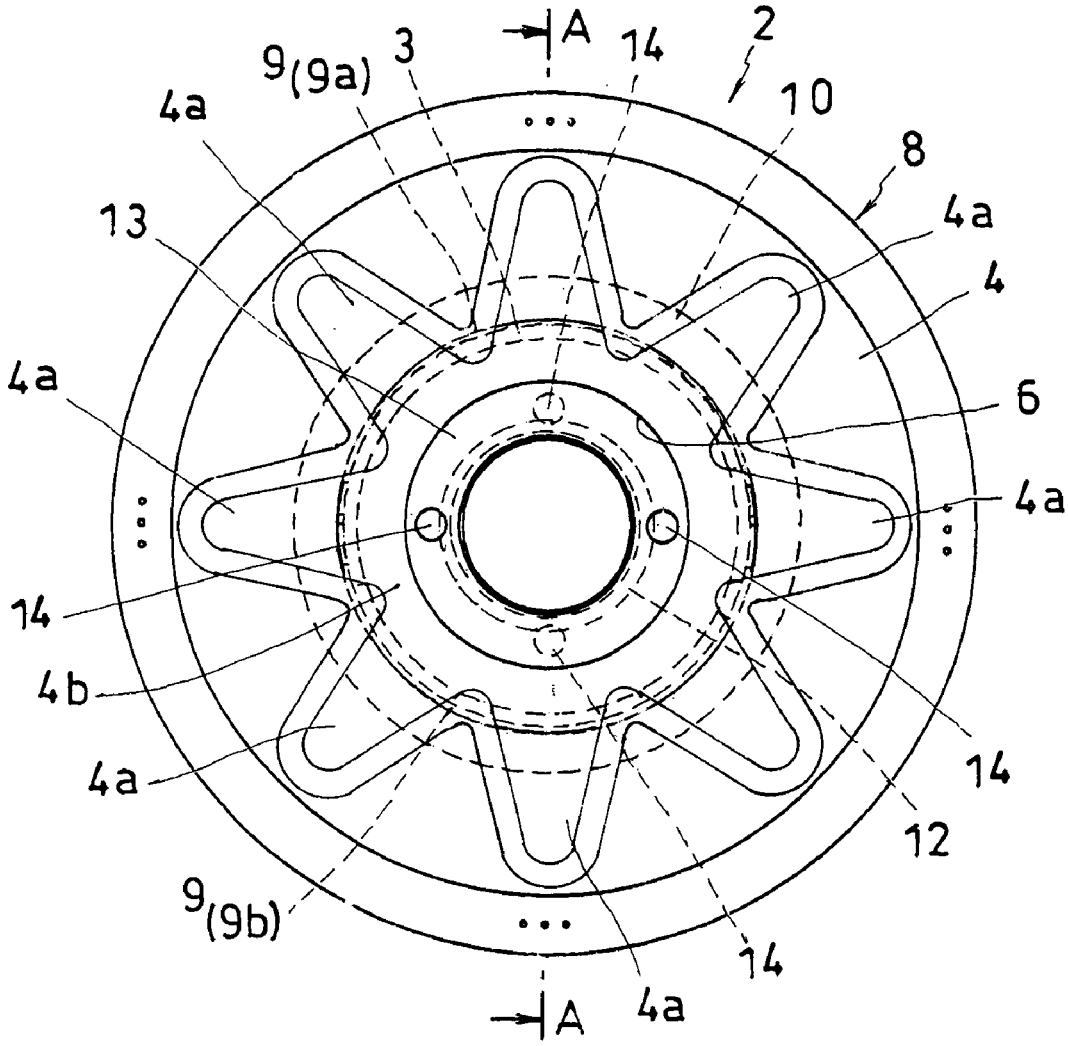
FIG. 2 is a front view of the reel of the embodiment.

A reel according to an embodiment illustrated in FIGS. 1 and 2 is a reel for a metal linear material which is used in a drawing machine or a twisting machine for a tire cord, or a wire saw. The reel is composed of a winding drum 1, and flanges 2 and 2 provided at both ends of the winding drum 1.

The winding drum 1 has a cylindrical drum member 3. The drum member 3 is produced by bending, for example, a cold-rolled high-tensile steel sheet (SAFC) into a cylindrical shape.

The flanges 2 and 2 is, for example, each composed of a first flange portion member 4 formed by pressing a hot-rolled high-tensile steel sheet (SAPH), and a second flange portion member 5 formed of a hot-rolled high-tensile steel sheet (SAPH). The first flange portion member 4 and the second flange portion member 5 are integrated together in a manner such that the first flange portion member 4 and the second flange portion member 5 are overlaid together in an axial direction, the first flange portion member 4 being provided at an outer position and the second flange portion member 5 being provided at an inner position.

A core hole 6 is formed at a center portion of the first flange portion member 4 by press forming. A plurality of side surface reinforcing portions 4*a* (the number of portions 4*a* is 8 in FIG. 1, preferably 6 to 12, and may be changed as appropriate) which substantially radially swell toward an outer surface of the flange (outward in the axial direction), are formed around the core hole 6. A ring-shaped core hole periphery reinforcing portion 4*b* which is continuous to the side surface reinforcing portions 4*a* and swells toward the outer surface of the flange, is formed along the core hole 6. The ring-shaped core hole periphery reinforcing portion 4*b* and the side surface reinforcing portion 4*a* constitute an integrally formed reinforcing portion. The side surface reinforcing portions 4*a* have the same shape and dimensions, and each have a divergent shape such that a width in a flange circumferential direction is gradually increased toward a center of the reel as viewed in a reel axial direction, and as illustrated in FIG. 1, each have a swelling height toward the flange outer surface which is increased toward the reel center as viewed in a direction perpendicular the reel axis. Also, the side surface reinforcing portions 4*a* are substantially equally spaced in the flange circumferential direction.

On the other hand, the second flange portion member 5 is formed in the shape of a doughnut and serves as an inner surface of the flange 2.

In each of the flanges 2 and 2, an outer edge portion of the first flange portion member 4 is bent back so that the outer edge portion is curled outward in the axial direction. An outer edge portion of the second flange portion member 5 is bent back outward in the axial direction at a substantially right angle to the flat inner wall 5*a* of the second flange portion member 5 forming an upper wall 8*a* which is parallel to the axis X-X of winding drum 1 and extends over the first flange portion member 4. Thereafter, upper wall 8*a* curls inward in the radial direction and is bend back to wrap the outer edge portion of the first flange portion member 4 that has been curled. As a result, a hollow ring-shaped flange outer edge reinforcing portion 8 is formed. Note that the flange outer edge reinforcing portion 8 and the core hole periphery reinforcing portion 4*b* are flush with each other in the reel axial direction.

When the flange outer edge reinforcing portion 8 is formed in this manner, the inner wall 5*a* of each of the flanges 2 and 2 which is substantially flat up to the upper wall 8*a*, permits a metal linear material to be wound up to the upper wall 8*a*.

The drum member 3 is fixedly joined to the first flange portion members 4 and 4 by welding. The winding drum 1 also comprises an outer drum 9 outside the drum member 3. The outer drum 9 is composed of a pair of half-cylindrical members 9*a* and 9*b*, which are combined via an undulate slit (the slit may be in any other shape, including a curve, a straight line, an angle, and the like). On both sides in the axial direction of the outer drum 9 outside the drum member 3 of the winding drum 1, spacers 10 and 10 formed in the shape of a ring having an L-shaped cross-section are provided which form reel surfaces flush with the outer drum 9 and flange surfaces flush with the second flange portion members 5 and 5. The spacers 10 and 10 are fixedly joined to the second flange portion members 5 and 5 of the flanges 2 and 2, respectively, by butt welding. Also, the outer drum 9 and the spacers 10 and 10 on both sides thereof are fixedly joined together by butt welding. The outer drum 9 and the spacers 10 and 10 are formed of, for example, a cold-rolled high-tensile steel sheet (SAFC).

Also, in the reel, a center core 11 is provided in the drum member 3 of the winding drum 1. The center core 11 extends in the axial direction substantially coaxially with the drum member 3, and both ends thereof are fixed to the respective corresponding core holes 6 and 6 of the flanges 2 and 2 on both the sides.

The center core 11 is composed of a cylindrical member 12 which is a pipe material made of, for example, structural carbon steel (e.g., S45C), and a pair of left and right ring-shaped boss members 13 and 13 which are fixed at both ends of the cylindrical member 12, have a thickness larger than that of the cylindrical member 12, and are formed by machining a thick steel material (e.g., structural carbon steel (e.g., S45C)). The boss members 13 and 13 at both the ends of the center core 11 are inserted into the core hole 6 and 6 of the flanges 2 and 2 on both the sides, followed by fixedly joining together by welding from the outside in the axial direction. A pair of kick holes 14 and 14 for starting rotation are provided on each of end surfaces of the left and right boss member 13 and 13. The left and right kick hole pairs have phases different by 90 degrees from each other.

Coaxially positioning members 15 and 15 are attached, and fixedly joined by welding, to outer circumferential portions of the left and right boss member 13 and 13 of the center core 11 so as to position the drum member 3 coaxially with the center core 11 throughout the whole area in the axial direction. The coaxially positioning members 15 and 15 are in the shape of a circular collar and have a shape and a dimension which allow an outer circumference thereof to contact an inner circumference of the drum member 3 in a sliding manner.

When the reel of this embodiment is manufactured, the drum member 3 and the half-cylindrical members 9*a* and 9*b* of the outer drum 9 constituting the winding drum 1, the multiplex flanges 2 and 2 obtained by integrating the first flange portion member 4 and the second flange portion member 5 together, the spacers 10 and 10, and the center core 11 comprising the coaxially positioning members 15 and 15, are previously separately produced, and thereafter, are assembled, for example, in the following procedure.

Initially, the boss member 13 at one end of the center core 11 is attached to the core hole 6 of the first flange portion member 4 of one of the flanges 2 and 2 from the second flange portion member 5 side, followed by fixation by welding from the outside in the axial direction.

Next, the drum member 3 is fitted to the outside of the center core 11 using the coaxially positioning members 15 and 15 as guides, to position the drum member 3 substantially coaxially with the center core 11 throughout the whole area in the axial direction. One end of the drum member 3 is fixedly joined to the first flange portion member 4 by welding.

Next, the spacers 10 and 10 are attached to the drum member 3 from the other end. Thereafter, the boss member 13 at the other end of the center core 11 is attached to the core hole 6 of the first flange portion member 4 of the other flange 2 from the second flange portion member 5 side, followed by fixedly joining together by welding.

Next, while both the spacers 10 and 10 are shifted closer to the one end of the drum member 3, the other end of the drum member 3 is fixedly joined to the first flange portion member 4 of the other flange 2 by welding.

Next, the spacers 10 and 10 are shifted closer to both the ends of the drum member 3, respectively. The half-cylindrical members 9*a* and 9*b* of the outer drum 9 are wrapped around the outside of the drum member 3 between the pair of spacers 10 and 10. In this situation, the spacers 10 and 10 are fixedly joined to inner circumferences of the respective corresponding second flange portion members 5 and 5 on both the sides by butt welding. Also, the outer drum 9 and the spacers 10 and 10 on both the ends thereof are fixedly joined by butt welding.

In the reel, the flange outer edge reinforcing portion 8 is bent back outward in the reel axial direction at a substantially right angle with respect to the substantially flat inner surface of each of the flanges 2 and 2. Therefore, the inner surfaces of the flanges 2 and 2 are substantially flat up to the very outer edges, so that a metal linear material can be wound up to the very flange outer edge.

Also in the reel, as described above, the flanges 2 and 2 have a multiplex structure in which the first flange portion member 4 at an outer position in the axial direction and the second flange portion member 5 at an inner position in the axial direction are overlaid together at an outer edge portion, and the outer edge portion is bent back to form a hollow ring-shaped flange outer edge reinforcing portion, thereby making it possible to increase the rigidity and strength of the flanges 2 and 2.

Also in the reel, as described above, the winding drum 1 is composed of the drum member 3, the outer drum 9, and the spacers 10 and 10, so that the winding drum 1 has a high level of rigidity and strength against a squeezing force when a metal linear material is wound around the winding drum 1.

Also in the reel, the flange outer edge reinforcing portion 8 and the core hole periphery reinforcing portion 4*b* are flush with each other in the reel axial direction, thereby making it possible to stack the reels in a stable manner during storage or transportation.

The exemplary embodiment has been heretofore described, however, the present invention is not limited to this. The present invention can be embodied and practiced in other different forms. For example, the winding drum may be made of a thick steel material.

The drum member 3, the outer drum 9, and the spacers 10 and 10 are preferably made of SAPH (hot-rolled high-tensile steel sheet) or the like as well as SAFC (cold-rolled high-tensile steel sheet). Also, the first flange portion member 4 and the second flange portion member 5 are preferably made of SPCC (cold-rolled high-tensile steel sheet) or the like as well as SAPH (hot-rolled high-tensile steel sheet). Alternatively, a material for the drum member 3, the outer drum 9, and the spacers 10 and 10, and a material for the first flange portion member 4 and the second flange portion member 5, may be structural carbon steel, such as S45C or the like.

The metal linear material reel of the present invention can be applied not only to a filament for a tire cord and a saw wire, but also to other metal linear materials.

What is claimed is:

1. A reel for a metal linear material comprising:

a winding drum; and flanges made of a steel sheet and fixedly joined at both ends of the winding drum, wherein the flanges each have a hollow ring-shaped flange outer edge reinforcing portion at an outer edge thereof, the hollow ring-shaped flange outer edge reinforcing portion being continuous to a substantially flat inner surface of the flange, wherein the flange outer edge reinforcing portion has a structure which is bent back outward in a reel axial direction at a substantially right angle with respect to the substantially flat inner surface;

wherein each flange comprises:

a plurality of flange members made of a steel sheet and overlaid together in an axial direction to form a multiplex structure, wherein a first flange member provided at an outer position in the axial direction and a second flange member provided at an inner position in the axial direction are overlaid together at an outer edge portion, and the overlaid outer edge portion is bent back throughout a whole circumference to form the flange outer edge reinforcing portion.

2. The reel according to claim 1 further comprising:

an outer drum provided outside a drum member of the winding drum; and ring-shaped spacers having an L-shaped cross-section provided at both sides in the axial direction of the outer drum, forming a reel surface flush with the outer drum and flange surfaces flush with the second flange members of the flanges, wherein both ends of the drum member are fixed to the first flange members of the flanges by welding, the spacers are fixed to inner circumferences of the second flange members of the flanges by butt welding, and the outer drum and the spacers at both the ends thereof are fixed to each other by butt welding.

3. A reel for a metal linear material comprising:

a winding drum; and flanges made of a steel sheet and fixedly joined at both ends of the winding drum, wherein the flanges each have a substantially flat inner wall and a hollow ring-shaped flange outer edge reinforcing portion at an outer edge of the inner wall, the hollow ring-shaped flange outer edge reinforcing portion being continuous to the flat inner wall, wherein the flange outer edge reinforcing portion has an upper wall which is bent back outward in a reel axial direction at a substantially right angle with respect to the flat inner wall.

4. The reel according to claim 3, wherein each flange comprises:

a plurality of flange members made of a steel sheet and overlaid together in an axial direction to form a multiplex structure, wherein a first flange member provided at an outer position in the axial direction and a second flange member provided at an inner position in the axial direction are overlaid together at an outer edge portion, and the overlaid outer edge portion is bent back throughout a whole circumference to form the flange outer edge reinforcing portion.

5. The reel according to claim 4 further comprising:

an outer drum provided outside a drum member of the winding drum; and ring-shaped spacers having an L-shaped cross-section provided at both sides in the axial direction of the outer drum, forming a reel surface flush with the outer drum and flange surfaces flush with the second flange members of the flanges, wherein both ends of the drum member are fixed to the first flange members of the flanges by welding, the spacers are fixed to inner circumferences of the second flange members of the flanges by butt welding, and the outer drum and the spacers at both the ends thereof are fixed to each other by butt welding.

6. The reel according to claim 3, wherein the upper wall is parallel to the axis of the winding drum.

* * * * *